US009023199B2

(12) United States Patent
Nishizawa

(10) Patent No.: US 9,023,199 B2
(45) Date of Patent: May 5, 2015

(54) DEVICE FOR SUPPRESSING SLIT CLOGGING

(75) Inventor: Shinya Nishizawa, Kurashiki (JP)

(73) Assignee: Sumitomo Heavy Industries Finetech, Ltd., Kurashiki-shi, Okayama (JP)

( * ) Notice: Subject to any disclaimer, the term of this patent is extended or adjusted under 35 U.S.C. 154(b) by 46 days.

(21) Appl. No.: 13/996,257

(22) PCT Filed: Dec. 14, 2011

(86) PCT No.: PCT/JP2011/078847

§ 371 (c)(1),
(2), (4) Date: Sep. 5, 2013

(87) PCT Pub. No.: WO2012/086475

PCT Pub. Date: Jun. 28, 2012

(65) Prior Publication Data

US 2013/0333151 A1 Dec. 19, 2013

(30) Foreign Application Priority Data

Dec. 24, 2010 (JP) ..... 2010-286997

(51) Int. Cl.
*B03C 1/30* (2006.01)
*B03C 1/247* (2006.01)
*B03C 1/28* (2006.01)

(52) U.S. Cl.
CPC . *B03C 1/30* (2013.01); *B03C 1/247* (2013.01); *B03C 1/284* (2013.01); *B03C 1/286* (2013.01)

(58) Field of Classification Search
CPC ..... B03C 1/30; B03C 1/247; B03C 1/284; B03C 1/286
See application file for complete search history.

(56) References Cited

U.S. PATENT DOCUMENTS

2008/0251435 A1* 10/2008 Tashiro et al. ..... 210/222

FOREIGN PATENT DOCUMENTS

| | | | |
|---|---|---|---|
| JP | 3010347 | U | 5/1995 |
| JP | H08-117689 | A | 5/1996 |
| JP | 2003-088710 | A | 3/2003 |
| JP | 2007-000978 | A | 1/2007 |
| JP | 2010-064164 | A | 3/2010 |
| WO | WO 2009/099188 | A1 | 8/2009 |

OTHER PUBLICATIONS

International Search Report and Written Opinion dated Jan. 24, 2012 corresponding to International Patent Application No. PCT/JP2011/078847.

* cited by examiner

*Primary Examiner* — David A Reifsnyder
(74) *Attorney, Agent, or Firm* — Squire Patton Boggs (US) LLP

(57) ABSTRACT

A device for suppressing slit clogging capable of maintaining recovery rates of ground particles without clogging of the ground particles in an opening is provided. The device for suppressing slit clogging is used in a rotating-drum type magnetic separator 1 which includes a rotating drum 3 on which a plurality of magnets 4 are disposed and separates unnecessary matters in treated coolant liquid. A slit-like opening 8 is provided below the rotating drum 3, and the device includes a cylindrical groove cam mechanism, which is configured by a cylindrical shaft 21 having a groove which can be rotated and a slit cleaning member 22 which engages with the groove, below the opening 8. The slit cleaning member 22 moves along a longitudinal direction of the opening 8.

9 Claims, 6 Drawing Sheets

1
5
6
7
3
4
10
8
16

DEVICE FOR SUPPRESSING SLIT CLOGGING

TECHNICAL FIELD

The present invention relates to a device for suppressing slit clogging which cleans a slit of a rotating-drum type magnetic separator which separates and recovers sludge included in used coolant liquid.

BACKGROUND ART

In cutting, grinding, or the like of a magnetic material which is represented by a metal material, particularly, a steel material, scrap, chips, or the like which is discharged along with coolant liquid are separated from the liquid and recovered. Since the scrap, chips, or the like have various shapes, various magnetic separation (recovery) devices have been developed from the viewpoint of recovery efficiency.

For example, PTL 1 discloses a rotating-drum type magnetic separator in the related art. FIG. 1 shows a configuration of the rotating-drum type magnetic separator in the related art and is a cross-sectional view at a surface perpendicular to a rotational axis of a rotating drum. As shown in FIG. 1, in the rotating-drum type magnetic separator 1 in the related art, a liquid reservoir portion 10 which stores coolant liquid in a box type main body is provided. In order to divide the liquid reservoir portion 10 into two, a rotating drum 3 is supported in an approximately horizontal direction in the vicinity of the center portion of the main body. The rotating drum 3 is a cylindrical body which is formed of a nonmagnetic material such as stainless steel, and an inner cylinder 5, in which a plurality of magnets 4, 4, . . . are disposed on the outer circumferential surface in a predetermined arrangement, is coaxially fixed to the inner portion of an outer cylinder. Polarities of the plurality of magnets 4, 4, . . . are disposed so as to generate a predetermined magnetic flux in the vicinity of the outer circumference surface of the rotating drum 3, so that scrap, chips, or the like which are magnetic bodies contained in the coolant liquid are magnetically attached.

In PTL 1, the plurality of magnets 4, 4, . . . are disposed between a portion in which the rotating drum 3 starts to be immersed in the liquid reservoir portion 10 and the top, that is, on the inner cylinder 5 corresponding to a portion equivalent to approximately ¾ of the outer circumferential surface of the rotating drum 3. The magnet 4 is not disposed on the inner cylinder 5 in the portion corresponding to the remaining approximately ¼, and a magnetic force is not applied on the portion.

Sludge, which is adsorbed on the outer circumference surface of the rotating drum 3 on the bottom portion of the liquid reservoir portion 10 by application of the magnetic force of the plurality of magnets 4, 4, . . . is transported to the top of the rotating drum 3 according to the rotation of the rotating drum 3. When the transported sludge passes through the top, adsorption forces generated due to the magnetic forces of the plurality of magnets 4, 4, . . . are lost, and the sludge is scratched away by a scraper 7 abutting on the rotating drum 3 and is recovered. A squeezing roller 6, in which an elastic body such as rubber is disposed on the surface, is provided in the vicinity of the top of the rotating drum 3, and the squeezing roller 6 is abutted on the outer circumference surface of the rotating drum 3 by a predetermined pressing force. The adsorbed sludge passes through between the rotating drum 3 and the squeezing roller 6, and thus, liquid contained in the sludge is squeezed, and only the scrap, chips, or the like is separated at the position in which the magnetic force does not reach.

In order to suppress the amount of accumulated ground particles which cannot be recovered, a slit-like opening 8 is provided on the bottom portion of a magnetic field channel 16 along the outer circumference surface of the rotating drum 3. The opening 8 is provided, and thus, it is possible to increase recovery rates of the scrap, chips, or the like while maintaining the recovery rate of the ground particles.

CITATION LIST

Patent Literature

[PTL 1] Japanese Unexamined Patent Application Publication No. 2007-000978

SUMMARY OF INVENTION

Technical Problem

In PTL 1, the ground particles are recovered from the slit-like opening 8. However, nonmagnetic particles or the like larger than an opening width are clogged in the opening 8, and there is a problem that the recovery rates of the ground particles may be largely decreased. Moreover, work to clean at fixed intervals is troublesome, and there is a concern that work efficiency in the entire process may be decreased.

The present invention is made in consideration of the above-described circumstances, and an object thereof is to provide a device for suppressing slit clogging capable of maintaining recovery rates of ground particles without clogging of the ground particles in the opening.

Solution to Problem

In order to achieve the object, according to a first aspect, there is provided a device for suppressing slit clogging which is used in a rotating-drum type magnetic separator which includes a rotating drum on which a plurality of magnets are disposed and separates unnecessary matters in treated coolant liquid, wherein a slit-like opening is provided below the rotating drum and a slit cleaning member, in which a portion is inserted into the opening, moves along a longitudinal direction of the opening.

In the first aspect, the device is used in the rotating-drum type magnetic separator which includes the rotating drum on which the plurality of magnets are disposed and separates unnecessary matters in treated coolant liquid. A slit-like opening is provided below the rotating drum, and the slit cleaning member, in which a portion is inserted into the opening, moves along a longitudinal direction of the opening. The slit cleaning member moves along the longitudinal direction of the slit-like opening, and thus, it is possible to suppress the opening from being clogged due to the ground particles.

Moreover, in the device for suppressing slit clogging according to a second aspect, in the first aspect, a moving mechanism which moves the slit cleaning member may be disposed so as to be approximately parallel to the opening and at a position separate from immediately below the opening.

In the second aspect, the moving mechanism which moves the slit cleaning member is disposed so as to be approximately parallel to the opening and at a position separate from immediately below the opening. Thereby, the movement of the slit cleaning member is not regulated by the ground particles which are discharged from the opening.

Moreover, in the device for suppressing slit clogging according to a third aspect, in the second aspect, a plate-like member may be mounted so as to be approximately parallel to the opening between the moving mechanism and the opening.

In the third aspect, since the plate-like member is mounted so as to be approximately parallel to the opening between the moving mechanism and the opening, the possibility that ground particles discharged from the opening may be guided to the moving mechanism is decreased, and the ground particles can be stably separated and recovered.

Moreover, in the device for suppressing slit clogging according to a fourth aspect, in any one of the first to the third aspects, a cylindrical groove cam mechanism, which is configured by a cylindrical shaft having a groove which can be rotated and the slit cleaning member which engages with the groove, may be provided below the opening as the moving mechanism.

In the fourth aspect, the cylindrical groove cam mechanism, which is configured by the cylindrical shaft having the groove which can be rotated and the slit cleaning member which engages with the groove, is provided below the opening as the moving mechanism, the slit cleaning member, which is connected to the cylindrical groove cam mechanism, moves along the longitudinal direction of the slit-like opening, and thus, the slit cleaning member can always move along the longitudinal direction of the opening in the opening, and it is possible to suppress the opening from being clogged due to the ground particles.

Moreover, in the device for suppressing slit clogging according to a fifth aspect, in the fourth aspect, in the cylindrical groove cam mechanism, the groove which is formed in an internal screw shape and a protrusion of the slit cleaning member which is formed in an external screw shape may be connected so as to be engaged with each other, and the slit cleaning member may move along the longitudinal direction of the opening according to a rotation of the shaft.

In the fifth aspect, in the cylindrical groove cam mechanism, the groove which is formed in an internal screw shape and the protrusion of the slit cleaning member which is formed in an external screw shape are connected so as to be engaged with each other. The slit cleaning member moves along the longitudinal direction of the slit-like opening according to the rotation of the shaft, and thus, clogging of the ground particles in the slit-like opening can be suppressed, and the ground particles can be separated and recovered in free maintenance.

Moreover, in the device for suppressing slit clogging according to a sixth aspect, in the fourth or fifth aspect, in the cylindrical groove cam mechanism, the groove may be formed in a cross screw shape, the protrusion of the slit cleaning member may be connected so as to be engaged with the groove, and the slit cleaning member may move along the longitudinal direction of the opening according to the rotation of the shaft.

In the sixth aspect, in the cylindrical groove cam mechanism, the groove is formed in a cross screw shape, and the protrusion of the slit cleaning member is connected so as to be engaged with the groove. The slit cleaning member moves along the longitudinal direction of the opening according to the rotation of the shaft, and thus, clogging of the ground particles in the slit-like opening can be suppressed, and the ground particles can be separated and recovered in free maintenance.

In addition, in the device for suppressing slit clogging according to a seventh aspect, in the sixth aspect, a rotation transmission mechanism, which transmits a rotation of a rotating shaft of the rotating drum to the shaft, may be provided on at least one end of the rotating shaft of the rotating drum, and the cylindrical groove cam mechanism may be operated by the rotation of the rotating drum.

In the seventh aspect, the rotation transmission mechanism, which transmits a rotation of a rotating shaft of the rotating drum to the shaft, is provided on at least one end of the rotating shaft of the rotating drum, and the cylindrical groove cam mechanism is operated by the rotation of the rotating drum. Thereby, it is not necessary to separately provide the power source to clean the slit-like opening and suppress the clogging of the ground particles, the shaft is rotated by the power source which rotates the rotating drum, and thus, the clogging of the ground particles in the opening can be suppressed by moving the slit cleaning member.

Moreover, in the device for suppressing slit clogging according to a eighth aspect, in the seventh aspect, in the rotation transmission mechanism, a chain unit may be mounted on at least one end of the shaft, and a continuous protrusion which can engage with the chain unit may be provided on at least one end of the rotation shaft of the rotating drum.

In the eighth aspect, as the rotation transmission mechanism, the chain unit is mounted on at least one end of the shaft, and the continuous protrusion which can engage with the chain unit is provided on at least one end of the rotation shaft of the rotating drum. Thereby, it is not necessary to separately provide the power source to clean the slit-like opening and suppress clogging of the ground particles, the shaft is rotated by the power source which rotates the rotating drum via the simple mechanism, and thus, clogging of the ground particles in the opening can be suppressed by moving the slit cleaning member.

In addition, in the device for suppressing slit clogging according to a ninth aspect, in the first aspect, two columnar members which can rotate and an annular member which is wound around the columnar members may be provided below the opening as a moving mechanism, and the slit cleaning member may be fixed to a portion of the annular member.

In the ninth aspect, two columnar members which can rotate and the annular member which is wound around the columnar members are provided below the opening as the moving mechanism, and the slit cleaning member is fixed to a portion of the annular member. Two columnar members are rotated and the annular member, which is wound around the columnar members, moves, and thus, the fixed slit cleaning member can move along the longitudinal direction of the slit-like opening, and it is possible to suppress the opening from being clogged due to the ground particles.

Advantageous Effects of Invention

According to the-above-described configurations, the slit-like opening is provided below the rotating drum, and the slit cleaning member, in which a portion is inserted into the opening, moves along the longitudinal direction of the opening. The slit cleaning member moves along the longitudinal direction of the slit-like opening, and thus, it is possible to suppress the opening from being clogged due to the ground particles.

DESCRIPTION OF EMBODIMENTS

Hereinafter, the present invention will be described in detail with reference to the drawings showing embodiments.

Embodiment 1

Figure 2:
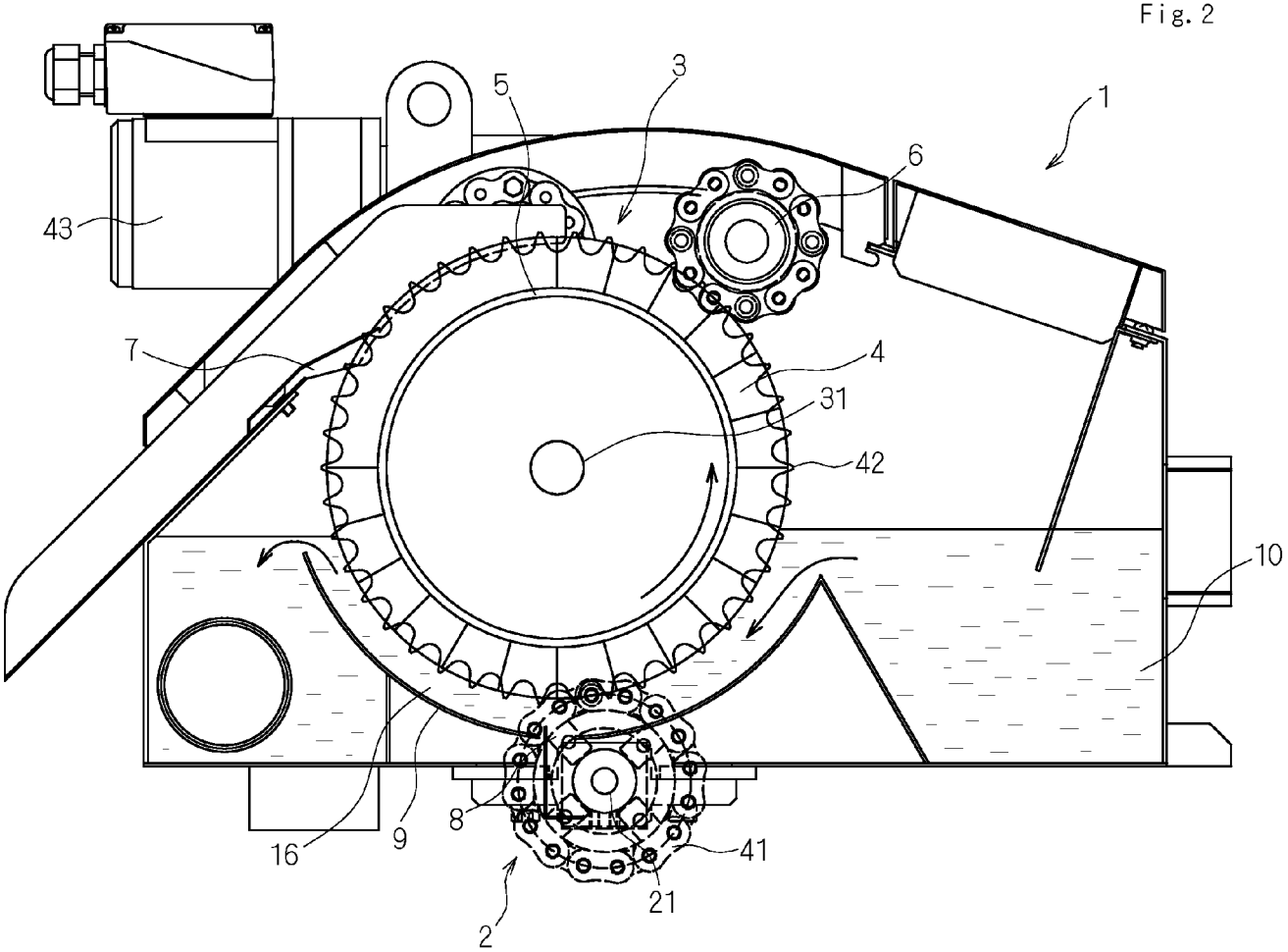
FIG. 2 shows a configuration of a rotating-drum type magnetic separator which uses a device for suppressing slit clogging according to Embodiment 1 of the present invention and is a cross-sectional view at a surface perpendicular to a rotational axis of a rotating drum.

FIG. 2 shows a configuration of a rotating-drum type magnetic separator which uses a device for suppressing slit clogging according to Embodiment 1 of the present invention and is a cross-sectional view at a surface perpendicular to a rotational axis of a rotating drum. As shown in FIG. 2, in a rotating-drum type magnetic separator 1 which uses the device for suppressing slit clogging according to Embodiment 1, a liquid reservoir portion 10 which stores coolant liquid in a box type main body is provided. In order to divide the liquid reservoir portion 10 into two, a rotating drum 3 is rotatably supported by a rotating shaft 31 in an approximately horizontal direction in the vicinity of the center portion of the main body.

The rotating drum 3 is a cylindrical body, which is formed of a nonmagnetic material such as stainless steel, and an inner cylinder 5, in which a plurality of magnets 4, 4, . . . are disposed, is coaxially fixed by the rotating shaft 31 in the inner portion on the outer circumferential surface of the rotating drum 3. The plurality of magnets 4, 4, . . . disposed on the inner cylinder 5 are disposed by appropriately adjusting magnetic poles so as to apply a necessary magnetic force to the outer circumferential surface of the rotating drum 3. In Embodiment 1, a neodymium-based magnet is used for the magnet 4, N and S become a pair, and the magnets are disposed in the order of N, S, N, S from one end of a squeezing roller 6 side.

A range where the magnetic force is applied to the rotating drum 3 is changed according to an outer diameter of the drum, a position of a scraper 7, or the like. In FIG. 2, the magnets 4, 4, . . . are disposed on the inner cylinder 5 so that adsorption force reaches a range of an approximately ¾ of the outer circumference surface, that is from a portion in which the rotating drum 3 starts to be immersed in the liquid reservoir portion 10 to the top, and the magnets are not disposed on the inner cylinder 5 in a range of the remaining approximately ¼ of the outer circumferential surface. The sludge containing scrap, chips, or the like which are adsorbed to the outer circumferential surface of the rotating drum 3 in a magnetic field channel 16 to which the magnetic force is applied, is transported up to the top of the rotating drum 3 by the rotation of the rotating drum 3.

The squeezing roller 6 is disposed in the vicinity of the top of the rotating drum 3, and is abutted on the outer circumferential surface of the rotating drum 3 by a predetermined pressing force. The liquid, which is contained in the sludge which is adsorbed to the outer circumferential surface of the rotating drum 3 and transported, is squeezed by the squeezing roller 6. When the scrap, chips, or the like, in which liquid is squeezed, pass the top, the scrap, chips, or the like are released from the adsorption force due to the magnetic forces of the magnets 4, 4, . . . , scraped by the plate-like scraper 7 abutting on the outer circumferential surface of the rotating drum 3, and recovered.

On the other hand, after the coolant liquid is stored in the liquid reservoir portion 10 at first, the coolant liquid passes through the magnetic field channel 16 which is formed by the rotating drum 3 and a casing bottom plate 9 disposed along the rotating drum 3. The coolant liquid passes through the magnetic field channel 16, and thus, the scrap, chips, or the like which are mixed in the liquid are separated and recovered.

Moreover, an opening 8 is provided at a position of the magnetic field channel 16 opposite to the outer cylinder of the rotating drum 3. The opening 8 has a parallel slit shape which is perpendicular to the rotation direction of the rotating shaft 31 of the rotating drum 3. The opening 8 is manufactured by processing stainless steel (SUS 304) having a flat plate shape at first by a laser or a turret punch so as to form a constant opening width in a thickness direction, and thereafter, by bending the stainless steel in an arc shape.

Figure 3:
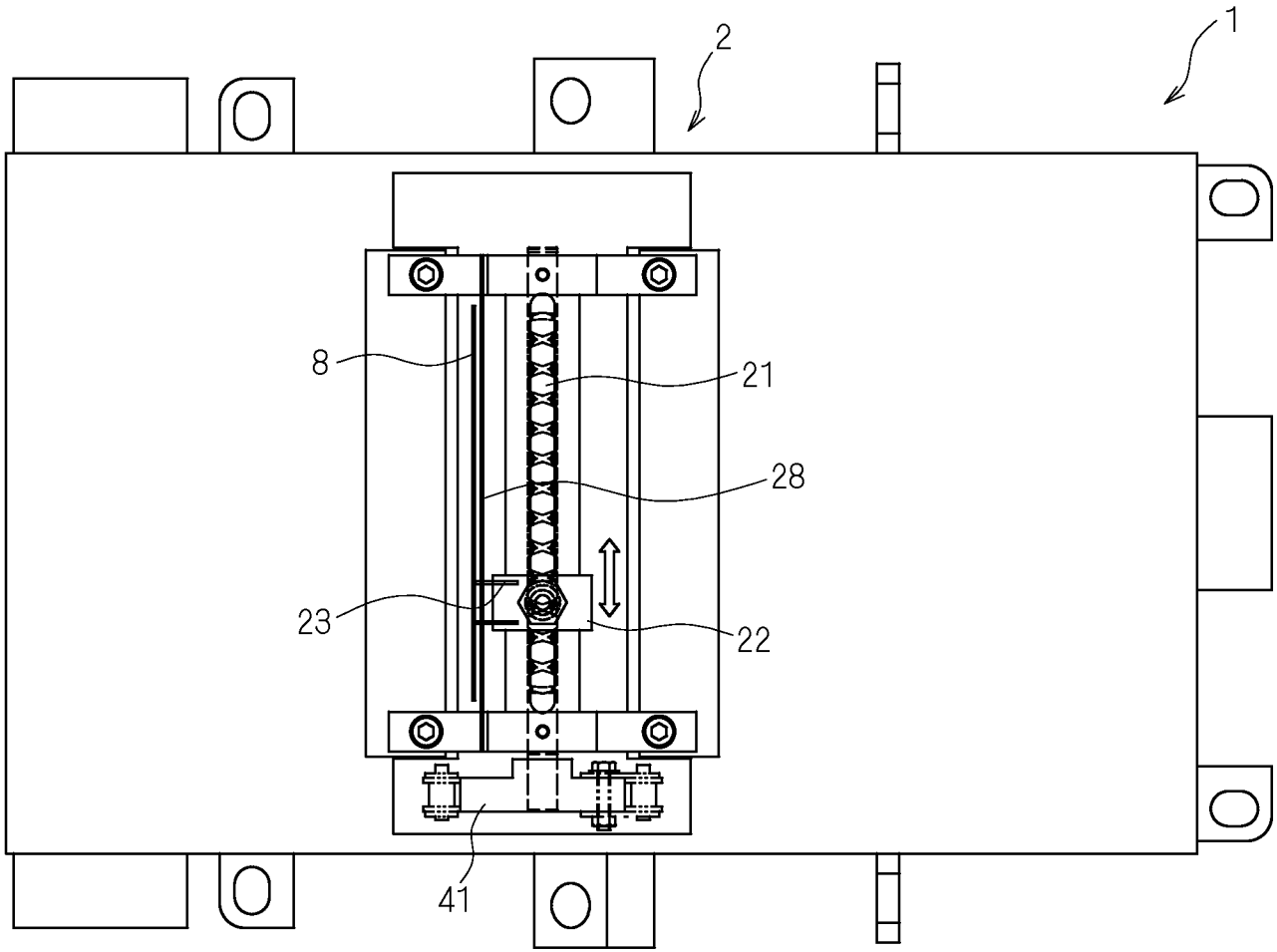
FIG. 3 is a plan view showing a configuration of the device for suppressing slit clogging according to Embodiment 1 of the present invention.

A device for suppressing silt clogging 2 which suppresses clogging of ground particles by cleaning the opening 8 is provided outside the opening 8. FIG. 3 is a plan view showing the configuration of the device for suppressing slit clogging 2 according to Embodiment 1 of the present invention. FIG. 3 is a view when the bottom surface of the rotating-drum type magnetic separator 1 is viewed from the bottom surface side.

As shown in FIG. 2, a cylindrical groove cam mechanism, which is configured by a cylindrical shaft 21 having a groove which can be rotated and a slit cleaning member 22 which engages with the groove, is provided below the opening 8 as a moving mechanism which moves the slit cleaning member 22. As shown in FIG. 3, the cylindrical shaft 21 is provided so as to be approximately parallel in the longitudinal direction of the slit-like opening 8 and is disposed at a position which is deviated in the rotation direction of the rotating drum 3 from immediately below the opening 8. Since the cylindrical shaft is deviated from immediately below the opening 8, the movement of the slit cleaning member 22 is not regulated by the ground particles which are discharged from the opening 8.

When the shaft 21 is rotated, the slit cleaning member 22 moves along the longitudinal direction of the opening 8 on the shaft 21. The slit cleaning member 22 moves, and thus, a slit cleaning pin 23 provided on the tip of the slit cleaning member 22 reciprocates along the longitudinal direction of the opening 8 in the slit-like opening 8, and the ground particles which are accumulated in the vicinity of the opening 8 can be effectively removed.

Moreover, it is preferable that a plate-like member 28 is mounted so as to be approximately parallel in the longitudinal direction of the opening 8 between the shaft 21 and the slit-like opening 8. The reason is because the possibility that the ground particles discharged from the opening 8 may be guided to the cylindrical groove cam mechanism is decreased, and thus, the ground particles can be stably separated and recovered.

In Embodiment 1, in the cylindrical groove cam mechanism, the groove included in the cylindrical shaft 21 is formed in a cross screw shape, and a protrusion of the slit cleaning member 22 is connected so as to be engaged with the groove. When the shaft 21 is rotated, the slit cleaning member 22 moves along the longitudinal direction of the opening 8 in the slit-like opening 8 according to the rotation of the shaft 21. The slit cleaning member 22 moves along the longitudinal direction of the opening 8 according to the rotation of the shaft 21, and thus, the clogging of the ground particles in the opening 8 can be suppressed, and the ground particles can be separated and recovered in free maintenance.

Figure 4A:
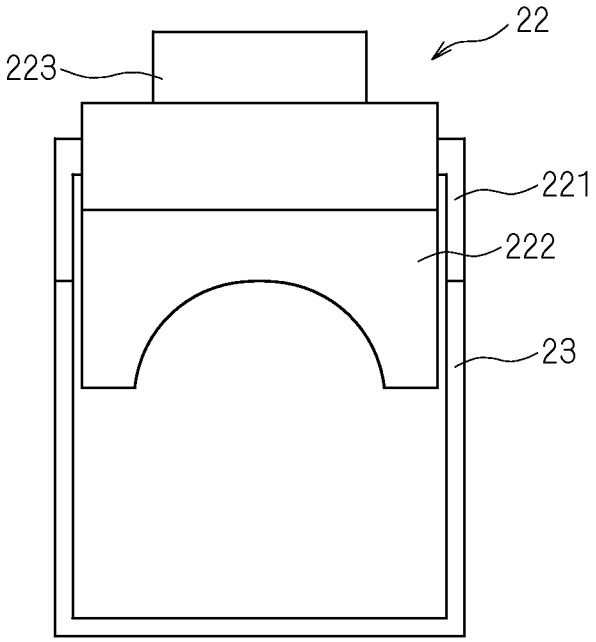
FIG. 4(*a*) is a front view and FIG. 4(*b*) is a side view showing a configuration of a slit cleaning member of the device for suppressing slit clogging according to Embodiment 1 of the present invention.
Figure 4B:
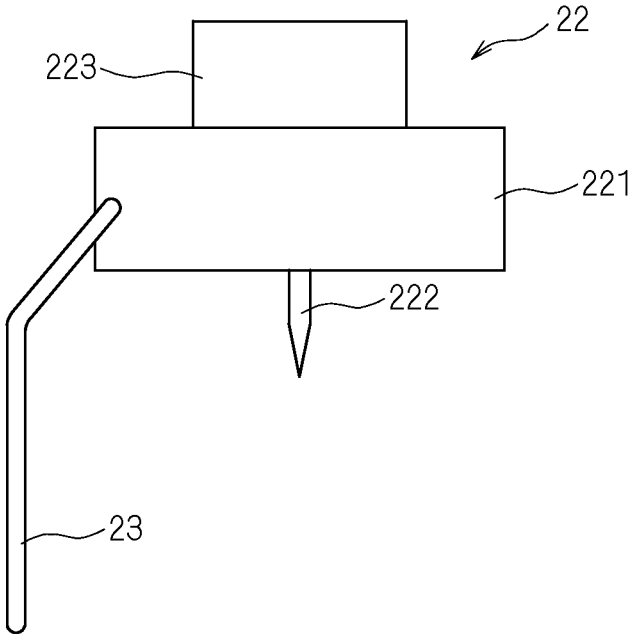

FIG. 4(*a*) is a front view and FIG. 4(*b*) is a side view showing a configuration of the slit cleaning member 22 of the device for suppressing slit clogging 2 according to Embodiment 1 of the present invention. FIG. 4(*a*) is a front view showing the configuration of the slit cleaning member 22 of the device for suppressing slit clogging 2 according to Embodiment 1 of the present invention, and FIG. 4(*b*) is a side view showing the configuration of the slit cleaning member 22 of the device for suppressing slit clogging 2 according to Embodiment 1 of the present invention.

The slit cleaning member 22 is connected to a main body portion 221 which reciprocates along the longitudinal direction of the opening 8 on the cylindrical shaft 21 so as to reciprocate on the shaft 21 via a protrusion 222 which engages with the groove of the shaft 21 and a fixed portion 223. The slit cleaning pin 23 has a shape which is curved toward the outside of the main body portion 221 so as to be inserted into the opening 8 at a position separate from the protrusion 222 which engages with the groove of the shaft 21. Thus, the possibility that the reciprocation of the slit cleaning pin 23 in the opening 8 may be impeded by the ground particles which are discharged from the opening 8 and drop can be decreased. Of course, the shape of the slit cleaning pin 23 is not limited to the shape shown in FIG. 4, and may have any shape if the slit cleaning pin 23 can be inserted into the slit-like opening 8 without disposing the shaft 21 at the position which is deviated from immediately below the opening 8.

Referring back to FIG. 2, a power source which rotates the shaft 21 is made to be common to a power source which rotates the rotating drum 3. That is, a rotation transmission mechanism which transmits the rotation of the rotating shaft 31 to the shaft 21 is provided on at least one end of the rotating shaft 31 of the rotating drum 3. Thereby, it is not necessary to separately provide the power source so as to clean the slit-like opening 8 and suppress clogging of the ground particles, the shaft 21 is rotated by the power source which rotates the rotating drum 3, and thus, clogging of the ground particles in the opening 8 can be suppressed by moving the slit cleaning member 22.

Specifically, in the rotation transmission mechanism, a chain unit 41 is mounted on at least one end of the shaft 21, and continuous protrusions 42 which can engage with the chain unit 41 are provided on at least one end of the rotating shaft 31 of the rotating drum 3. Thereby, it is not necessary to separately provide the power source to clean the slit-like opening 8 and suppress clogging of the ground particles, the shaft 21 is rotated by the power source which rotates the rotating drum 3 via the simple mechanism, and thus, clogging of the ground particles in the opening 8 can be suppressed by moving the slit cleaning member 22.

That is, as shown in FIG. 2, when a motor 43, which is a power source rotating the rotating drum 3, is rotated, the rotating shaft 31 of the rotating drum 3 is rotated in a counterclockwise direction, and the sludge, which contains scrap, chips, or the like adsorbed to the plurality of magnets 4, 4, . . . , is transported up to the top of the rotating drum 3. When the sludge passes the top of the rotating drum 3, the sludge is released from the adsorption forces due to the magnetic forces of the plurality of magnets 4, 4, . . . , scraped away by the plate-like scraper 7 abutting on the outer circumferential surface of the rotating drum 3, and recovered.

The rotating shaft 31 of the rotating drum 3 is rotated in a counterclockwise direction, and thus, the chain unit 41, which engages with the plurality of continuous protrusions 42, 42, . . . , is rotated in a clockwise direction. The chain unit 41 is rotated in a clockwise direction, and thus, the shaft 21 is also rotated in a clockwise direction. According to the rotation of the shaft 21, in which the protrusion 222 of the slit cleaning member 22 is connected by engaging with the groove formed in a cross screw shape, the slit cleaning member 22 linearly moves along any direction of the longitudinal direction of the opening 8.

When the protrusion 222 of the slit cleaning member 22 reaches one end of the opening 8, since the groove is formed in a cross screw shape, without a change in the rotation direction of the shaft 21, the protrusion 222 of the slit cleaning member 22 linearly moves from the one end of the opening 8 in which the protrusion has reached toward the opposite direction. Therefore, since the slit cleaning member 22 moves along the longitudinal direction of the slit-like opening 8 while the rotating drum 3 is continuously rotated, clogging of the ground particles in the opening 8 can be suppressed, and the ground particles can be separated and recovered in free maintenance.

As described above, according to Embodiment 1, the slit cleaning member 22, which is connected to the cylindrical groove cam mechanism which is a moving mechanism, moves along the longitudinal direction of the slit-like opening 8, and thus, the slit cleaning pin 23 of the slit cleaning member 22 can always move along the longitudinal direction of the opening 8 in the opening 8, and it is possible to suppress the opening 8 from being clogged due to the ground particles. Moreover, since the cylindrical groove cam mechanism can be operated by the power source which rotates the rotating drum 3 via a simple mechanism such as the chain unit 41, it is not necessary to separately provide the power source so as to clean the slit-like opening 8 and suppress the clogging of the ground particles.

Embodiment 2

Figure 1:
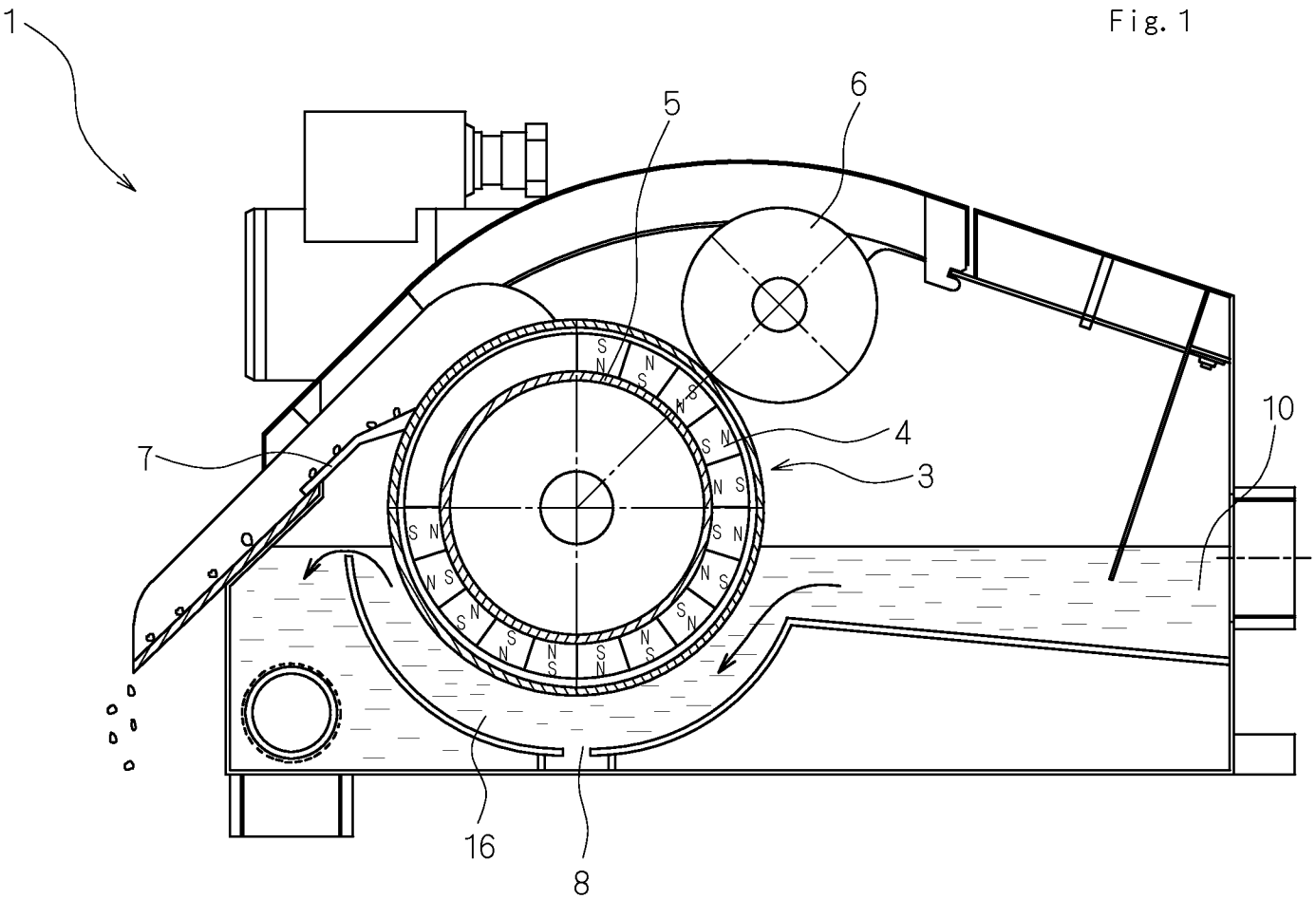
RELATED ART Fig. 1
FIG. 1 shows a configuration of a rotating-drum type magnetic separator in the related art and is a cross-sectional view at a surface perpendicular to a rotational axis of a rotating drum.

A configuration of the rotating-drum type magnetic separator 1 itself which uses a device for suppressing slit clogging according to Embodiment 2 of the present invention is similar to the configuration in the related art (refer to FIG. 1), the same reference numerals are attached, and the detailed descriptions are omitted. Embodiment 2 is different from Embodiment 1 in that clogging of the ground particles are suppressed by cleaning the slit-like opening 8 manually.

Figure 5:
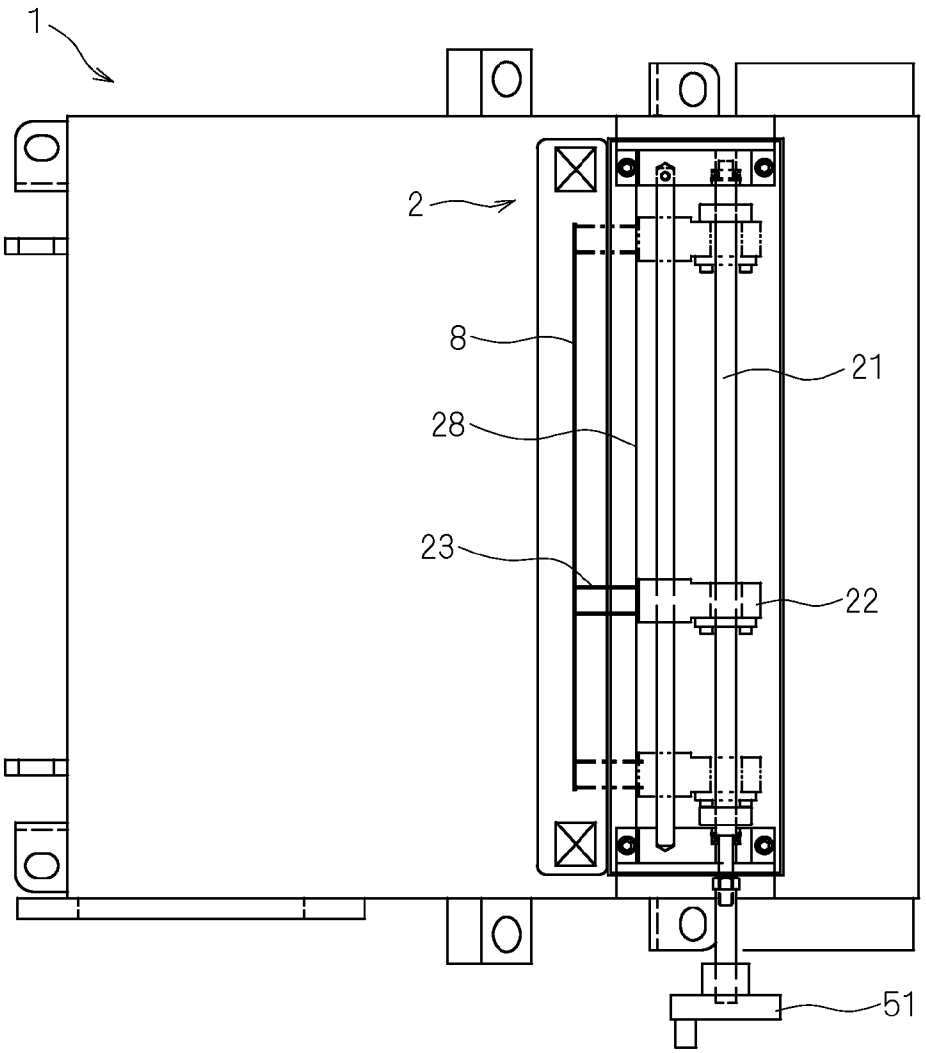
FIG. 5 is a plan view showing a configuration of a device for suppressing slit clogging according to Embodiment 2 of the present invention.

The device for suppressing silt clogging 2 which suppresses clogging of ground particles in the opening 8 by cleaning the opening 8 is provided outside the opening 8. FIG. 5 is a plan view showing a configuration of the device for suppressing slit clogging 2 according to Embodiment 2 of the present invention. FIG. 5 is a view when the bottom surface of the rotating-drum type magnetic separator 1 is viewed from the bottom surface side.

As shown in FIG. 2, a cylindrical groove cam mechanism, which is configured by the cylindrical shaft 21 having a groove which can be rotated and the slit cleaning member 22 which engages with the groove, is provided below the opening 8. As shown in FIG. 5, the cylindrical shaft 21 is provided so as to be approximately parallel in the longitudinal direction of the slit-like opening 8 and is disposed at a position which is deviated in the rotation direction of the rotating drum 3 from immediately below the opening 8. Since the cylindrical shaft is deviated from immediately below the opening 8, the movement of the slit cleaning member 22 is not regulated by the ground particles which are discharged from the opening 8.

A groove having an internal screw shape is formed on the cylindrical shaft 21, and the protrusion 222 having an external screw shape is formed on the slit cleaning member 22. The groove of the shaft 21 and the protrusion 222 of the slit cleaning member 22 is connected so as to be engaged with each other, and the slit cleaning member 22 moves along the longitudinal direction of the slit-like opening 8 according to the rotation of the shaft 21.

An operating handle 51 which can rotate the shaft 21 manually is provided on one end of the shaft 21. For example, when the operating handle 51 is rotated in a clockwise direction, the shaft 21 is also rotated in a clockwise direction. According to the rotation of the shaft 21, in which the protrusion 222 of the slit cleaning member 22 is connected by engaging with the groove formed in a cross screw shape, the slit cleaning member 22 linearly moves in a direction which approaches the operation handle 51 along the longitudinal direction of the opening 8.

Conversely, when the operating handle 51 is rotated in a counterclockwise direction, the shaft 21 is also rotated in a counterclockwise direction. According to the rotation of the shaft 21, the slit cleaning member 22 linearly moves in a direction separate from the operating handle 51 along the longitudinal direction of the opening 8 via the protrusion 222 which engages with the groove of the shaft 21.

Accordingly, by rotating the operating handle 51 appropriately, since the slit cleaning pin 23 provided on the tip of the slit cleaning member 22 reciprocates along the longitudinal direction of the opening 8 in the slit-like opening 8, the ground particles which are accumulated in the vicinity of the opening 8 can be effectively removed.

In addition, it is preferable that the plate-like member 28 is mounted so as to be approximately parallel in the longitudinal direction of the opening 8 between the shaft 21 and the slit-like opening 8. The reason is because the possibility that the ground particles discharged from the opening 8 may be guided to the cylindrical groove cam mechanism is decreased, and thus, the ground particles can be stably separated and recovered.

According to Embodiment 2 as described above, in the cylindrical groove cam mechanism, the groove which is formed in an internal screw shape and the protrusion 222 of the slit cleaning member 22 which is formed in an external screw shape is connected so as to be engaged with each other. The slit cleaning member 22 moves along the longitudinal direction of the slit-like opening 8 according to the rotation of the shaft 21, and thus, the clogging of the ground particles in the slit-like opening 8 can be suppressed, and the ground particles can be separated and recovered in free maintenance. Moreover, since the cylindrical groove cam mechanism can be operated manually, it is not necessary to provide a power source separately from the power source which rotates the rotating drum 3 so as to clean the slit-like opening 8 and suppress the clogging of the ground particles.

Embodiment 3

A configuration of the rotating-drum type magnetic separator 1 itself which uses a device for suppressing slit clogging according to Embodiment 3 of the present invention is similar to the configuration in the related art (refer to FIG. 1), the same reference numerals are attached, and the detailed descriptions are omitted. Embodiment 3 is different from Embodiments 1 and 2 in that the moving mechanism which moves the slit cleaning member 22 is a circular member which is wound around two columnar members.

Figure 6:
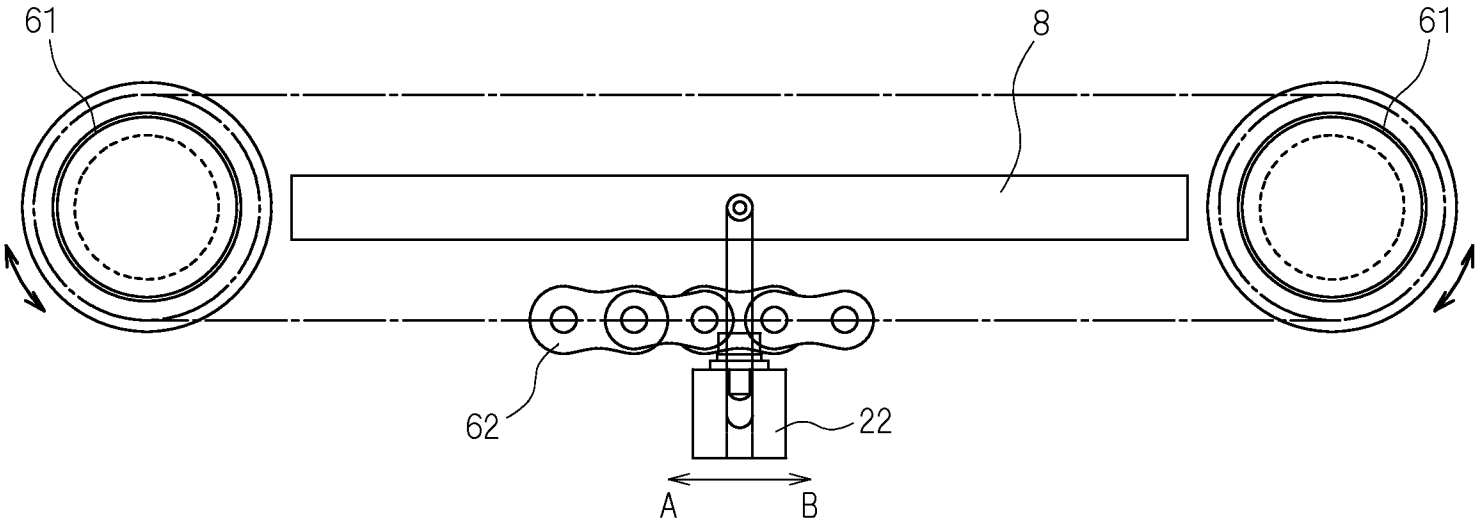
FIG. 6 is a plan view showing a configuration of a device for suppressing slit clogging according to Embodiment 3 of the present invention.

A device for suppressing silt clogging 2 which suppresses clogging of ground particles in the opening 8 by cleaning the opening 8 is provided outside the opening 8. FIG. 6 is a plan view showing a configuration of the device for suppressing slit clogging 2 according to Embodiment 3 of the present invention. FIG. 6 is a view when the bottom surface of the rotating-drum type magnetic separator 1 is viewed from the bottom surface side.

As shown in FIG. 6, a moving mechanism, which is configured by two columnar members 61 and 61 which can be rotated and an annular member 62 which is wound around the columnar members 61 and 61, is provided below the opening 8. For example, two sprockets are used as the columnar members 61 and 61, a chain belt is used as the annular member 62, and the slit cleaning member 22 is fixed to a portion of the chain belt. Of course, the invention is not limited to the combination of the sprocket and the chain belt, and any configuration such as a combination of a roller and a belt may be adopted if the annular member 62 moves according to the rotation of two columnar members 61 and 61.

When the columnar members 61 and 61 are rotated at the same rotation angular velocity in the same direction, the annular member 62 moves in any direction of arrow directions of FIG. 6. For example, when the columnar members 61 and 61 are rotated in a clockwise direction, the annular member 62 moves in an arrow A direction, and when the columnar members 61 and 61 are rotated in a counterclockwise direction, the annular member 62 moves in an arrow B direction.

According to the movement of the annular member 62, the slit cleaning member 22 which is fixed to the annular member 62 also moves along the longitudinal direction of the slit-like opening 8. Since a portion of the slit cleaning member 22 is inserted into the opening 8, the ground particles which are accumulated in the vicinity of the opening 8 can be effectively removed.

As described above, according to Embodiment 3, two columnar members 61 and 61 which can be rotated and the annular member 62 which is wound around the columnar members 61 and 61 are provided below the opening 8, and the slit cleaning member 22 is fixed to the annular member 62. Two columnar members 61 and 61 are rotated and the annular member 62, which is wound around the columnar members, moves, and thus, a portion of the fixed slit cleaning member 22 is inserted into the slit-like opening 8 and moves along the longitudinal direction of the opening 8. Since a portion of the inserted slit cleaning member 22 moves, the ground particles which are accumulated in the vicinity of the opening 8 can be removed, and clogging of the opening 8 due to the ground particles can be suppressed.

Moreover, the present invention is not limited the above-described embodiments, and various modifications, improvements, or the like within a scope of the gist of the present invention are possible. For example, in Embodiment 1, as the rotation transmission mechanism, the configuration is described in which the chain unit 41 is mounted on at least one end of the shaft 21 and the continuous protrusions 42 which can engage with the chain unit 41 are provided on at least one end of the rotating shaft 31 of the rotating drum 3. However, the chain units 41 may be provided on both ends of the shaft 21, and in addition to the chain unit, if the rotation transmission mechanism can transmit a rotation such as a gear mechanism or a belt mechanism, the rotation transmission mechanism is not particularly limited.

REFERENCE SIGNS LIST

10 liquid reservoir portion
3 rotating drum
4 magnets
5 inner cylinder
6 squeezing roller
8 opening
21 shaft
22 slit cleaning member
23 slit cleaning pin
41 chain unit
42 protrusion
51 operating handle
61 columnar member
62 annular member

The invention claimed is:

1. A device for suppressing slit clogging which is used in a rotating-drum type magnetic separator which includes a rotating drum on which a plurality of magnets are disposed and separates unnecessary matters in treated coolant liquid, wherein a slit-like opening is provided below the rotating drum, and a slit cleaning member, in which a portion is inserted into the slit-like opening, moves along a longitudinal direction of the slit-like opening.

2. The device for suppressing slit clogging according to claim 1, wherein a moving mechanism which moves the slit cleaning member is disposed so as to be approximately parallel to the longitudinal direction of the slit-like opening and at a position bellow but deviated from being immediately below the slit-like opening.

3. The device for suppressing slit clogging according to claim 2, wherein a plate-like member is mounted so as to be approximately parallel to the longitudinal direction of the slit-like opening between the moving mechanism and the slit-like opening.

4. The device for suppressing slit clogging according to claim 1, wherein a cylindrical groove cam mechanism, which is configured by a cylindrical shaft having a groove which can be rotated and the slit cleaning member which engages with the groove, is provided below the slit-like opening as a moving mechanism.

5. The device for suppressing slit clogging according to claim 4, wherein in the cylindrical groove cam mechanism, the groove which is formed in an internal screw shape and a protrusion of the slit cleaning member which is formed in an external screw shape are connected so as to be engaged with each other, and the slit cleaning member moves along the longitudinal direction of the slit-like opening according to a rotation of the cylindrical shaft.

6. The device for suppressing slit clogging according to claim 4, wherein in the cylindrical groove cam mechanism, the groove is formed in a cross screw shape, the protrusion of the slit cleaning member is connected so as to be engaged with the groove, and the slit cleaning member moves along the longitudinal direction of the slit-like opening according to a rotation of the cylindrical shaft.

7. The device for suppressing slit clogging according to claim 6, wherein a rotation transmission mechanism, which transmits a rotation of a rotating shaft of the rotating drum to the shaft, is provided on at least one end of the rotating shaft of the rotating drum, and the cylindrical groove cam mechanism is operated by the rotation of the rotating drum.

8. The device for suppressing slit clogging according to claim 7, wherein in the rotation transmission mechanism, a chain unit is mounted on at least one end of the shaft, and a continuous protrusion which can engage with the chain unit is provided on at least one end of the rotation shaft of the rotating drum.

9. The device for suppressing slit clogging according to claim 1, wherein two columnar members which can rotate and an annular member which is wound around the columnar members are provided below the slit-like opening as a moving mechanism, and the slit cleaning member is fixed to a portion of the annular member.

* * * * *